US010312633B2

(12) United States Patent
Tryson et al.

(10) Patent No.: US 10,312,633 B2
(45) Date of Patent: Jun. 4, 2019

(54) DUAL CONNECTOR SYSTEM HAVING A SECURING STRAP

(71) Applicant: TE CONNECTIVITY CORPORATION, Berwyn, PA (US)

(72) Inventors: Michael Joseph Tryson, Spring Grove, PA (US); Nathan Lincoln Tracy, Harrisburg, PA (US); Michael David Herring, Apex, NC (US); Dean Marlin Harmon, III, Harrisburg, PA (US)

(73) Assignee: TE CONNECTIVITY, Berwyn, PA (US)

( * ) Notice: Subject to any disclaimer, the term of this patent is extended or adjusted under 35 U.S.C. 154(b) by 0 days.

(21) Appl. No.: 15/723,287

(22) Filed: Oct. 3, 2017

(65) Prior Publication Data

US 2019/0103707 A1 Apr. 4, 2019

(51) Int. Cl.

| | |
|---|---|
| ***H01R 12/00*** | (2006.01) |
| ***H01R 13/627*** | (2006.01) |
| ***H01R 12/71*** | (2011.01) |
| ***H01R 12/70*** | (2011.01) |

(52) U.S. Cl.

CPC ..... *H01R 13/6278* (2013.01); *H01R 12/7005* (2013.01); *H01R 12/716* (2013.01)

(58) Field of Classification Search

CPC ..... H01R 13/6278; H01R 12/7088; H01R 13/62988; H01R 27/02; H01R 12/7005; H01R 12/716; G06F 1/185

USPC ..... 439/76.1

See application file for complete search history.

(56) References Cited

U.S. PATENT DOCUMENTS

| | | | |
|---|---|---|---|
| 3,479,634 | A | 11/1969 | Pritulsky |
| 4,678,252 | A | 7/1987 | Moore |
| 5,242,312 | A | 9/1993 | Tondreault |
| 5,260,854 | A | 11/1993 | Hileman et al. |
| 5,324,204 | A | 6/1994 | Lwee |
| 5,643,001 | A | 7/1997 | Kaufman et al. |
| 6,394,817 | B1 | 5/2002 | Kihira et al. |
| 7,018,222 | B2 | 3/2006 | Chang |
| 7,074,090 | B2 | 7/2006 | Ho et al. |
| 7,101,222 | B2 | 9/2006 | Ho et al. |
| 7,300,298 | B2 | 11/2007 | Kameda |

(Continued)

OTHER PUBLICATIONS

Tyco Electronic, Product Specification, DDR S.O.DIMM Socket 200 Positions, Jul. 11, 2007, 5 pages.

(Continued)

*Primary Examiner* — Jean F Duverne

(57) ABSTRACT

A dual connector system includes a host circuit board and first and second electrical connectors mounted to the host circuit board. The first electrical connector has a housing having a card slot for a module circuit board and the second electrical connector has a housing having an upper mating surface for the module circuit board. The housing has a first side and an opposite second side with connector latching features and holding second contacts at the upper mating surface between the first and second sides. A dual connector module is mated to the first and second electrical connectors. A securing strap is secured to the dual connector module and has a first strap latching feature being latchably coupled to the corresponding connector latching feature to secure the dual connector module to the second electrical connector.

20 Claims, 5 Drawing Sheets

(56) References Cited

U.S. PATENT DOCUMENTS

| | | | | |
|---|---|---|---|---|
| 7,344,402 | B2 * | 3/2008 | Langgood | H01R 13/62988 439/157 |
| 7,467,963 | B2 | 12/2008 | Chen | |
| 7,470,136 | B2 | 12/2008 | Yahiro et al. | |
| 7,510,414 | B2 | 3/2009 | Yu et al. | |
| 7,909,644 | B1 | 3/2011 | Li et al. | |
| 7,987,584 | B2 * | 8/2011 | Barna | H05K 7/1415 29/259 |
| 8,113,883 | B2 | 2/2012 | Chen et al. | |
| 8,544,831 | B2 * | 10/2013 | Klein | B25B 5/068 269/134 |
| 8,588,561 | B2 | 11/2013 | Zbinden et al. | |
| 8,764,457 | B2 | 7/2014 | Chen et al. | |
| 8,787,711 | B2 | 7/2014 | Zbinden et al. | |
| 9,166,315 | B1 | 10/2015 | Phillips et al. | |
| 9,871,325 | B2 | 1/2018 | Patel et al. | |
| 9,972,927 | B2 | 5/2018 | Nichols et al. | |
| 9,991,615 | B1 | 6/2018 | Herring et al. | |
| 2007/0099470 | A1 | 5/2007 | Yang | |
| 2010/0165592 | A1 | 7/2010 | Takao | |
| 2012/0327576 | A1 | 12/2012 | Xiao et al. | |
| 2014/0094063 | A1 | 4/2014 | Daly | |
| 2014/0111931 | A1 * | 4/2014 | Casserly | G06F 1/185 361/679.32 |
| 2014/0179167 | A1 * | 6/2014 | Long | H01R 12/7088 439/630 |
| 2015/0318633 | A1 | 11/2015 | Herring et al. | |
| 2016/0134040 | A1 | 5/2016 | Phillips et al. | |
| 2018/0076587 | A1 * | 3/2018 | Herring | H01R 27/02 |
| 2018/0309213 | A1 | 10/2018 | Harmon et al. | |

OTHER PUBLICATIONS

TE Connectivity Emboss Assembly DDR1 & DDR2 SODIMM Socket 200P Standard Profile Standard Type, Drawing No. C-1565917, Dec. 2001, 1 page.

U.S. Appl. No. 15/458,099, filed Mar. 14, 2017.

U.S. Appl. No. 15/490,252, filed Apr. 18, 2017.

U.S. Appl. No. 15/492,070, filed Apr. 20, 2017.

* cited by examiner

DUAL CONNECTOR SYSTEM HAVING A SECURING STRAP

BACKGROUND OF THE INVENTION

The subject matter herein relates generally to a dual connector system.

Dual connector systems include first and second electrical connectors mounted to a host circuit board that are electrically connected to a dual connector module. The dual connector module includes a module circuit board having connector interfaces for interfacing with the first and second electrical connectors. Typically communication components are mounted to the module circuit board. For example, electrical and/or optical components may be mounted to the module circuit board. In various applications an on-board optics module may be mounted to the module circuit board. Heat dissipation of the communication components may be provided, such as in the form of a heat sink thermally coupled to the communication components and supported by the module circuit board.

Mating of the dual connector module to the first and second electrical connectors typically involves loading the dual connector module into a first position in a vertical direction and then sliding the dual connector module to a second position in a horizontal direction to mate with the first and second electrical connectors. However, proper mating of the module circuit board to both electrical connectors simultaneously may be difficult. Additionally, securing the dual connector module to the first and second electrical connectors may be problematic. For example, holding the rear end of the dual connector module downward on the second electrical connector to ensure adequate electrical connection between the dual connector module and the second electrical connector may be problematic. Conventional dual connector systems utilize J-shaped hooks on the outer sides of the second electrical connector to make physical contact with the upper surface of the module circuit board of the dual connector module to hold the module circuit board downward against the contacts of the second electrical connector. Notches are formed in the module circuit board to receive the J-shaped hooks. However, such notches take away potential component area of the module circuit board and narrow the paths for routing electrical traces through the module circuit board.

A need remains for a dual connector system that secures the dual connector module with the first and second electrical connectors on the host circuit board for proper mating.

BRIEF DESCRIPTION OF THE INVENTION

In one embodiment, a dual connector system is provided including a host circuit board having a front mounting area with a first electrical connector at the front mounting area having a housing having a card slot holding first contacts at the card slot being terminated to the host circuit board and a rear mounting area with a second electrical connector at the rear mounting area having a housing having an upper mating surface, a first side and an opposite second side and holding second contacts at the upper mating surface between the first and second sides and with connector latching features at the first and second sides of the housing. The dual connector system includes a dual connector module mated to the first and second electrical connectors having a module circuit board including an upper surface and a lower surface facing the host circuit board having at least one communication component on the upper surface and front contact pads proximate to the front edge for electrically connecting to the first electrical connector and rear contact pads remote from the front edge for electrically connecting to the second electrical connector. The dual connector system includes a securing strap secured to the dual connector module having a first strap latching feature at a first end of the securing strap being latchably coupled to the first connector latching feature to secure the dual connector module to the second electrical connector.

In another embodiment, a dual connector system is provided including a host circuit board having a front mounting area with a first electrical connector at the front mounting area having a housing having a card slot holding first contacts at the card slot being terminated to the host circuit board and a rear mounting area with a second electrical connector at the rear mounting area having a housing having an upper mating surface, a first side and an opposite second side and holding second contacts at the upper mating surface between the first and second sides and with connector latching features at the first and second sides of the housing. The dual connector system includes a dual connector module mated to the first and second electrical connectors having a module circuit board including an upper surface and a lower surface facing the host circuit board having at least one communication component on the upper surface and front contact pads proximate to the front edge for electrically connecting to the first electrical connector and rear contact pads remote from the front edge for electrically connecting to the second electrical connector. The dual connector system includes a first securing strap secured to the dual connector module having a first strap latching feature at a distal end of the first securing strap being latchably coupled to the first connector latching feature to secure the dual connector module to the second electrical connector and a second securing strap secured to the dual connector module having a second strap latching feature at a distal end of the second securing strap being latchably coupled to the second connector latching feature to secure the dual connector module to the second electrical connector.

In a further embodiment, a dual connector system is provided including a host circuit board having a front mounting area with a first electrical connector at the front mounting area having a housing having a card slot holding first contacts at the card slot being terminated to the host circuit board and a rear mounting area with a second electrical connector at the rear mounting area having a housing having an upper mating surface, a first side and an opposite second side and holding second contacts at the upper mating surface between the first and second sides and with connector latching features at the first and second sides of the housing. The dual connector system includes a dual connector module mated to the first and second electrical connectors having a module circuit board including an upper surface and a lower surface facing the host circuit board having at least one communication component on the upper surface and front contact pads proximate to the front edge for electrically connecting to the first electrical connector and rear contact pads remote from the front edge for electrically connecting to the second electrical connector. The dual connector system includes a securing strap secured to the dual connector module having a first strap latching feature at a first end of the securing strap. The dual connector module is coupled to the host circuit board by lowering the dual connector module in a loading direction generally perpendicular to the host circuit board to a pre-staged position where the first connector interface is adjacent to the first electrical connector and the second connector interface is adjacent to the second electrical connector. The dual connector module is slid forward from the pre-staged position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads. The first strap latching feature is aligned with and latchably coupled to the first connector latching feature in the mated position to secure the dual connector module to the second electrical connector.

DETAILED DESCRIPTION OF THE INVENTION

Figure 1:
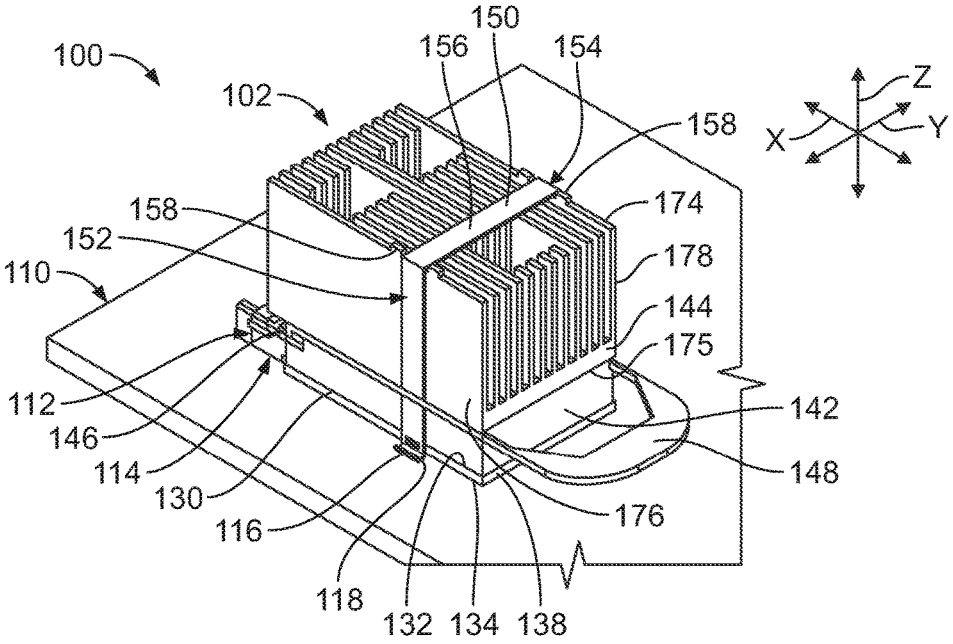
FIG. 1 is a perspective view of a dual connector system formed in accordance with an exemplary embodiment showing a dual connector module mounted to a host circuit board.
Figure 2:
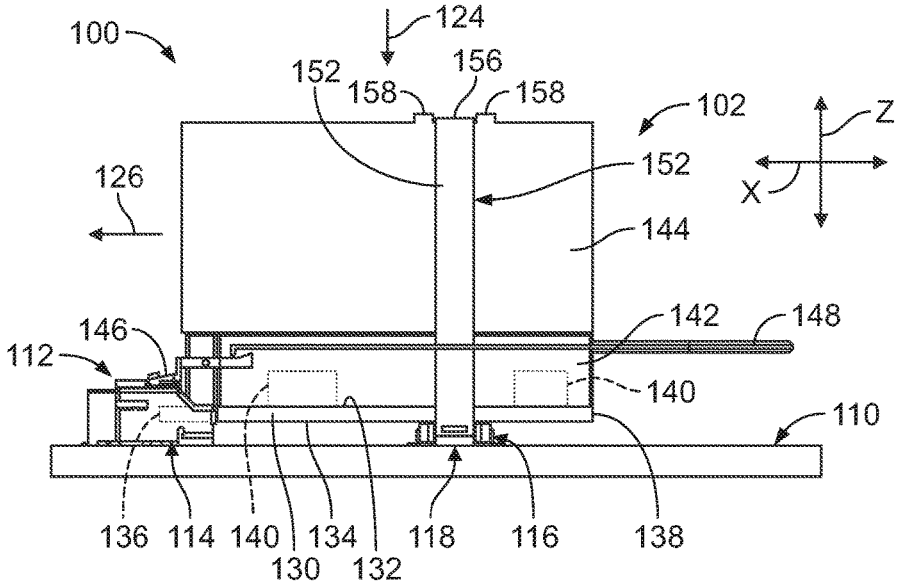
FIG. 2 is a side view of the dual connector system showing the dual connector module mounted to the host circuit board.

FIG. 1 is a perspective view of a dual connector system 100 formed in accordance with an exemplary embodiment showing a dual connector module 102 mounted to a host circuit board 110. FIG. 2 is a side view of the dual connector system 100 showing the dual connector module 102 mounted to the host circuit board 110. The host circuit board 110 has a first electrical connector 112 at a front mounting area 114 of the host circuit board 110 and a second electrical connector 116 at a rear mounting area 118 of the host circuit board 110.

When the dual connector module 102 is mounted to the host circuit board 110, the dual connector module interfaces with both electrical connectors 112, 116. Optionally, the dual connector module 102 may be simultaneously mated with the first and second electrical connectors 112, 116 during a mating process. In an exemplary embodiment, the first electrical connector 112 is a different type of electrical connector than the second electrical connector 116. For example, the first electrical connector 112 may be a front loaded electrical connector, such as a card edge connector. The second electrical connector 116 may be a top loaded electrical connector, such as a—axis or mezzanine connector. The electrical connectors 112, 116 may be used for different types of signaling. For example, the first electrical connector 112 may be used for high-speed signaling while the second electrical connector 116 may be used for low speed signaling, powering, or for another type of connection.

In an exemplary embodiment, mating of the dual connector module 102 to the host circuit board 110 occurs by loading the dual connector module 102 in a loading direction 124 (for example, Z-axis or downward) to a pre-staged position and then mating the dual connector module 102 in a mating direction 126 (for example, X-axis or forward) to a mated position. The loading direction 124 may be perpendicular to the host circuit board 110, such as in a vertical direction, and the mating direction 126 may be parallel to the host circuit board 110, such as in a horizontal direction.

The dual connector module 102 includes a module circuit board 130 having an upper surface 132 and a lower surface 134. The module circuit board 130 extends between a front edge 136 (shown in phantom) and a rear edge 138. The lower surface 134 faces the host circuit board 110 and may be parallel to and spaced apart from the host circuit board 110 when mated to the electrical connectors 112, 116.

In an exemplary embodiment, the dual connector module 102 includes one or more communication components 140 on the upper surface 132 and/or the lower surface 134. The communication components 140 may be electrical components, optical components, or other types of components. In an exemplary embodiment, one or more of the communication components 140 may be on-board optical modules. The communication components 140 may include optical/digital converters for converting between optical and electrical signals. Other types of communication components 140 may be provided on the module circuit board 130, such as processors, memory modules, antennas, or other types of components.

In an exemplary embodiment, the dual connector module 102 includes a housing or shell 142 on the upper surface 132. The shell 142 encloses the communication components 140. In an exemplary embodiment, the shell 142 extends generally around the perimeter of the module circuit board 130; however, portions of the module circuit board 130 may be exposed exterior of the shell 142. In an exemplary embodiment, the dual connector module 102 includes a heat sink 144 thermally coupled to one or more of the communication components 140. The heat sink 144 dissipates heat from the communication components 140. The heat sink 144 may be mounted to the shell 142 and/or the module circuit board 130. In an exemplary embodiment, the heat sink 144 extends substantially the entire length of the dual connector module 102. The heat sink 144 may have a plurality of fins having a large surface area for dissipating heat.

In an exemplary embodiment, the dual connector module 102 includes a latch 146 at a front end of the dual connector module 102 for latchably securing the dual connector module 102 to the first electrical connector 112. A tether 148 is coupled to the latch 146 and extends to the rear end of the dual connector module 102 for releasing the latch 146.

In an exemplary embodiment, the dual connector module 102 includes one or more securing straps 150 for securing the dual connector module 102 to the second electrical connector 116. The securing strap 150 may be removably coupled to the second electrical connector 116, such as to one or both sides of the second electrical connector 116. In an exemplary embodiment, the securing strap 150 is latchably coupled to the second electrical connector 116. The securing strap 150 extends to the top of the dual connector module 102, such as above the heat sink 144, to hold the dual connector module 102 down on the second electrical connector 116 in a mated position. The securing strap 150 may wrap at least partially around the dual connector module 102, such as around the heat sink 144, to extend along both sides and the top of the dual connector module 102. In an exemplary embodiment, the securing strap 150 is secured to a top 174 of the heat sink 144 to press a bottom 175 of the heat sink 144 downward. In an exemplary embodiment, the securing strap 150 is secured to a first side 176 of the heat sink 144, such as for connecting to a first side of the second electrical connector 116 and the securing strap 150 is secured to a second side 178 of the heat sink 144, such as for connecting to a second side of the second electrical connector 116.

In the illustrated embodiment, both first and second ends 152, 154 of the securing strap 150 are coupled to the second electrical connector 116 and an upper band 156 of the securing strap 150 wraps around the top of the dual connector module 102. The upper band 156 extends the entire width of the dual connector module 102. Optionally, the upper band 156 may be expandable or contractible to accommodate different width dual connector modules 102. The first and second ends 152, 154 extend along the sides of the dual connector module 102 to distal ends, which are configured to be coupled to the second electrical connector 116. Optionally, the first and second ends 152, 154 may be elastically deformable, such as to stretch around a corresponding latching feature on the second electrical connector 116 when the securing strap 150 is coupled to the second electrical connector 116. Such elastic deformation creates an internal bias in the securing strap 150 to pull the dual connector module 102 downward against the second electrical connector 116. Optionally, the first end 152 and/or the second end 154 may be expandable or contractible to accommodate different heights of dual connector modules 102 and/or different mounting locations with second electrical connectors 116 in various embodiments.

The securing strap 150 may pull downward on the dual connector module 102 to force the dual connector module 102 into electrical connection with the second electrical connector 116. The securing strap 150 may resist rearward movement of the dual connector module 102 when coupled to the second electrical connector 116. The securing strap may be coupled to the dual connector module 102 after the dual connector module 102 is slid forward to the mated position and coupled to both the first and second electrical connectors 112, 116. Alternatively, the securing strap 150 may be affixed to the dual connector module 102 and moved with the dual connector module 102 as the dual connector module 102 is slid forward to the mated position. The securing strap 150 is aligned with the second electrical connector 116 when the dual connector module 102 is in the mated position.

In an exemplary embodiment, the dual connector module 102 includes one or more guide features 158 for locating the securing strap 150 relative to the dual connector module 102. For example, the guide features 158 may be protrusions, tabs, flanges and the like extending outward from outer surfaces of the dual connector module 102, such as from the heat sink 144, to position the securing strap 150. Optionally, the guide features 158 may be positioned both forward of and rearward of the securing strap 150 to locate the securing strap 150. The guide features 158 may align the securing strap 150 with the second electrical connector 116. The guide features 158 may be provided along the top of the heat sink 144, as in the illustrated embodiment, and/or along other parts of the dual connector module 102, such as along the sides of the heat sink 144, along the shell 142 and/or along the module circuit board 130. Other types of guide features 158 may be provided in alternative embodiments, such as grooves or channels formed in the dual connector module 102, such as in the heat sink 144.

In alternative embodiments, rather than having a single securing strap 150 extending from one side, across the top and to the other side of the dual connector module 102, the dual connector module 102 may alternatively include two separate straps (for example, the first end 152 defining a first securing strap 150 and the second end 154 defining a second securing strap 150 without the upper band 156). The two securing straps 150 may be individually secured to the dual connector module 102. The securing straps 150 may be secured using fasteners, adhesive, clips, and the like.

In other alternative embodiments, the securing strap 150 may be secured to and extend along the shell 142 and/or the module circuit board 130 rather than extending above the top of the heat sink 144. For example, the securing strap 150 may be assembled prior to mounting the heat sink 144 to the shell 142 and/or the module circuit board 130.

Figure 3:
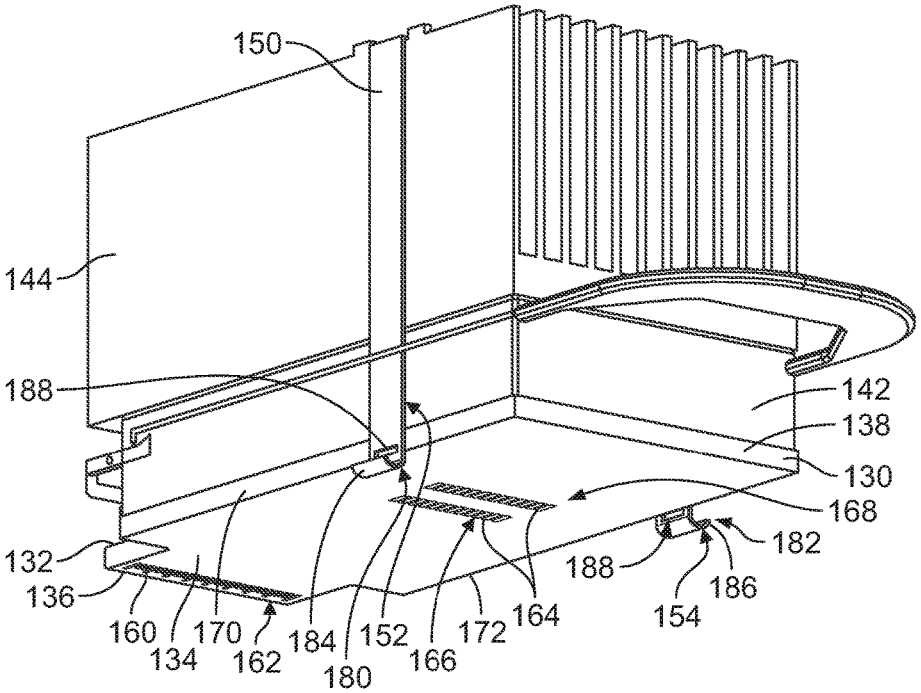
FIG. 3 is a bottom perspective view of the dual connector module in accordance with an exemplary embodiment.

FIG. 3 is a bottom perspective view of the dual connector module 102 and the securing strap 150 in accordance with an exemplary embodiment. In an exemplary embodiment, the module circuit board 130 includes front contact pads 160 proximate to the front edge 136 along the lower surface 134 and/or the upper surface 132. The front contact pads 160 define a first connector interface 162 configured for electrically connecting to the first electrical connector 112 (shown in FIG. 2). For example, the first connector interface 162 may be a card edge interface at the front edge 136 configured to be plugged into a card slot of the first electrical connector 112. The front contact pads 160 are circuits of the module circuit board 130. The front contact pads 160 may be electrically connected to corresponding communication components 140 (shown in FIG. 2) via traces on various layers of the module circuit board 130. In an exemplary embodiment, the front contact pads 160 convey high speed data signals. Optionally, various front contact pads 160 may be arranged in pairs configured to carry differential signals.

The module circuit board 130 includes rear contact pads 164 on the lower surface 134 that define a second connector interface 166 configured for electrically connecting to the second electrical connector 116 (shown in FIG. 2). The rear contact pads 164 may be electrically connected to corresponding communication components 140 via traces on various layers of the module circuit board 130. Optionally, at least some of the rear contact pads 164 may be power pads configured to transmit power between the second electrical connector 116 and the module circuit board 130 for powering the communication components 140. Optionally, the rear contact pads 164 may be provided in multiple rows along the lower surface 134. The rear contact pads 164 are provided at an intermediate portion 168 of the module circuit board 130 remote from the front edge 136 and remote from the rear edge 138. Optionally, the rear contact pads 164 are positioned closer to the rear edge 138 than the front edge 136. Optionally, the securing strap 150 may be coupled to the dual connector module 102 generally in-line with the rear contact pads 164 for connection with the second electrical connector 116. The securing strap 150 extends to both side edges 170, 172 of the module circuit board 130. In other various embodiments, separate securing straps 150 may be provided at the opposite sides of the dual connector module 102 extend to the respective side edges 170, 172.

The securing strap 150 extends between the first end 152 and the second end 154. The securing strap 150 may be manufactured from a shape memory material, such as a metal material that is stamped and formed into a predetermined shape corresponding to the shape of the dual connector module 102 to wrap partially around the dual connector module 102. The securing strap 150 may have other shapes in alternative embodiments. The securing strap 150 may be plastically deformed during the forming process to a predetermined shape. The securing strap 150 may be manufactured from other materials in alternative embodiments, such as a plastic material being molded into a predetermined shape corresponding to the shape of the dual connector module 102 to wrap partially around the dual connector module 102.

The securing strap 150 includes first and second strap latching features 180, 182 at distal ends 184, 186 of the first and second ends 152, 154, respectively. The first and second strap latching features 180, 182 are configured to interact with the second electrical connector 116 to secure the securing strap 150 to the second electrical connector 116. The first and second strap latching features 180, 182 are configured to be latchably coupled to the second electrical connector 116. For example, the first and second strap latching features 180, 182 may be snapably coupled around corresponding latching features of the second electrical connector 116. In the illustrated embodiment, the first and second strap latching features 180, 182 include openings 188 that receive portions of the second electrical connector 116 to secure the securing strap 150 thereto. Other types of latching features may be provided in alternative embodiments, such as clips, slots, tabs, springs and the like. In the illustrated embodiment, the distal ends 184, 186 are curled or flared outward away from the second electrical connector 116, such as to avoid stubbing during assembly. However, the distal ends 184, 186 may be flat or non-flared in alternative embodiments or may be curled or flared inward with the curled end defining the first and second strap latching features 180, 182 configured to engage the second electrical connector 116.

When assembled, the securing strap 150 secures the dual connector module 102 to the second electrical connector 116. Optionally, the securing strap 150 may be coupled to the second electrical connector 116 such that the securing strap 150 induces a downward biasing force on the dual connector module 102 when the first and second strap latching features 180, 182 are latchably coupled to corresponding latching features of the second electrical connector 116 to force the rear contact pads 164 downward on corresponding contacts of the second electrical connector 116.

Figure 4:
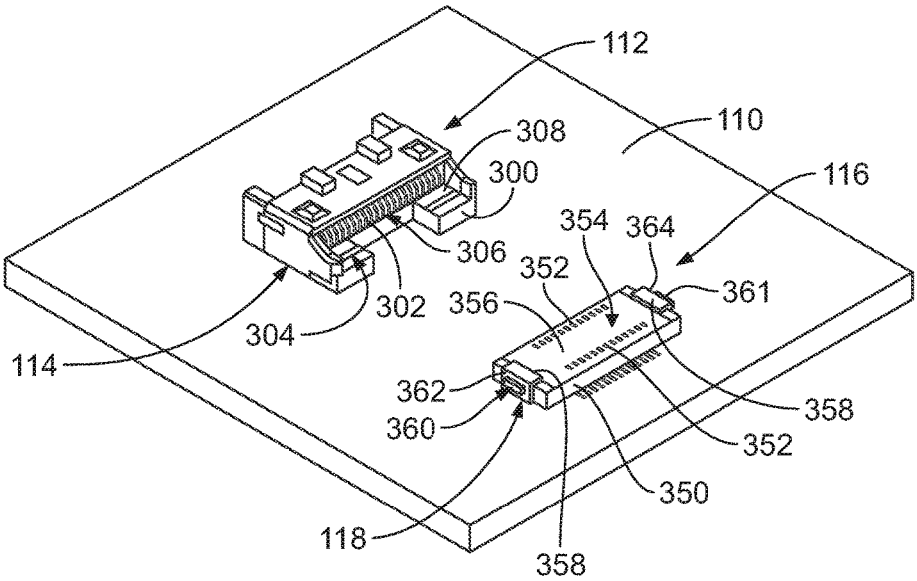
FIG. 4 is a top perspective view of the host circuit board in accordance with an exemplary embodiment.

FIG. 4 is a top perspective view of the host circuit board 110 in accordance with an exemplary embodiment. The host circuit board 110 includes mounting areas for mounting the dual connector module 102 (shown in FIG. 3) to the host circuit board 110. The mounting area is subdivided into the front mounting area 114 receiving the first electrical connector 112 and the rear mounting area 118 receiving the second electrical connector 116.

With additional reference to FIG. 3 for reference to components of the dual pluggable module 102, the first electrical connector 112 includes a housing 300 mounted to the host circuit board 110. The housing 300 holds a plurality of first contacts 302 configured to be terminated to the host circuit board 110. The housing 300 has a mating end 304 configured to be mated with the first connector interface 162 (FIG. 3) of the dual connector module 102. In an exemplary embodiment, the first electrical connector 112 includes a card slot 306 at the mating end 304. The first contacts 302 are arranged in the card slot 306 for mating with the first connector interface 162. For example, the first contacts 302 may be arranged in an upper row and a lower row for interfacing with the front contact pads 160 (FIG. 3) on the upper surface 132 and the lower surface 134 at the front edge 136 of the module circuit board 130.

The housing 300 includes locating surfaces 308 at the mating end 304 for locating the module circuit board 130 relative to the card slot 306 during mating. For example, the locating surfaces 308 may be upward facing surfaces configured to support the front edge 136 of the module circuit board 130 in the pre-staged position. The module circuit board 130 may slide along the locating surfaces 308 during mating as the front edge 136 of the module circuit board 130 is loaded into the card slot 306. The locating surfaces 308 may support the module circuit board 130 in the mated position to prevent damage to the first contacts 302 from the weight of the dual connector module 102.

Figure 5:
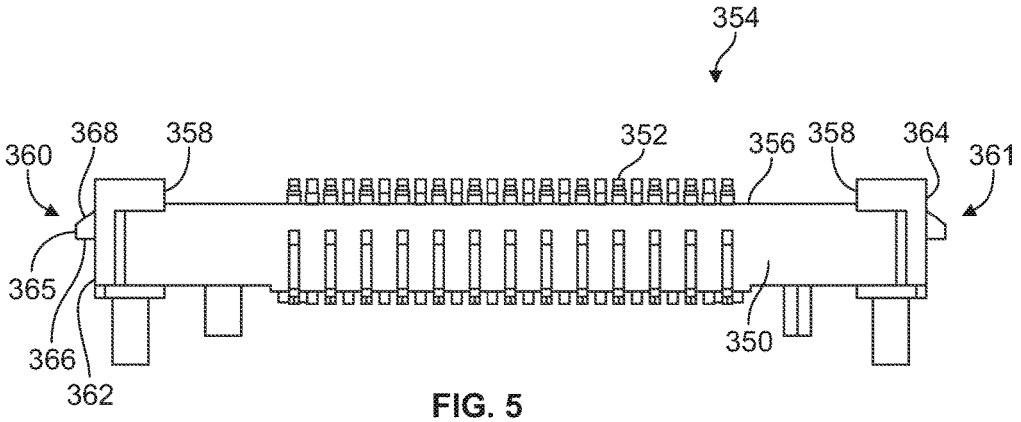
FIG. 5 is an end view of a second electrical connector of the host circuit board in accordance with an exemplary embodiment.

With additional reference to FIG. 5, which is an end view of the second electrical connector 116 in accordance with an exemplary embodiment, the second electrical connector 116 includes a housing 350 mounted to the host circuit board 110. The housing 350 holds a plurality of second contacts 352 configured to be terminated to the host circuit board 110. The housing 350 has a mating end 354 (for example, defining the top) configured to be mated with the second connector interface 166 (FIG. 3) of the dual connector module 102. In an exemplary embodiment, the second electrical connector 116 includes an upper mating surface 356 at the mating end 354. The second contacts 352 are arranged along the upper mating surface 356, such as in one or more rows, for mating with the second connector interface 166. The second contacts 352 may include deflectable spring beams configured to be resiliently biased against the second connector interface 166 when the dual connector module 102 is mated to the second electrical connector 116.

The housing 350 includes locating surfaces 358 at the mating end 354 for locating the module circuit board 130 during mating. For example, the locating surfaces 358 may be shoulders, flanges, tabs, and the like configured to locate the module circuit board 130 by restricting side-to-side movement of the module circuit board 130. The locating surfaces 358 may define a pocket that receives the module circuit board 130.

The housing 350 includes first and second connector latching features 360, 361 extending from the housing 350 at opposite sides 362, 364 of the housing 350. The first and second connector latching features 360, 361 may be integral with the base of the housing 350. In the illustrated embodiment, the first and second connector latching features 360, 361 include projections, such as latching tabs 365, extending from the housing 350. The first and second connector latching features 360, 361 have downward facing catch surfaces 366 configured to engage the securing strap 150 (shown in FIG. 1). The catch surfaces 366 may be generally horizontal surfaces in various embodiments; however, the catch surfaces 366 may be undercut or angled in alternative embodiments, such as to hold the securing strap 150 on the housing 350. The first and second connector latching features 360, 361 have ramp surfaces 368 opposite the catch surfaces 366. The ramp surfaces 368 may guide loading of the securing strap 150 onto the latching tab 365.

Figure 6:
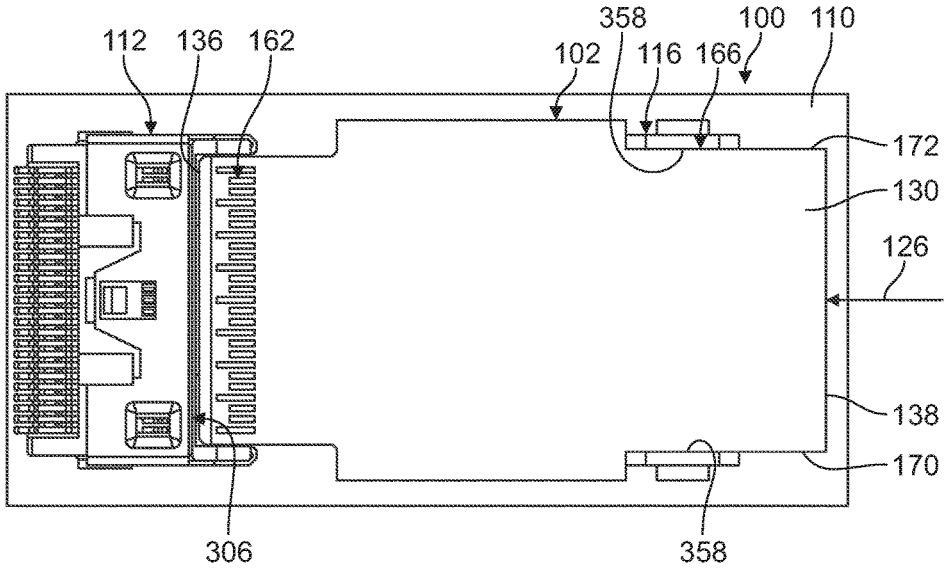
FIG. 6 is a top view of a portion of the dual connector system showing a module circuit board partially mated to the host circuit board.
Figure 7:
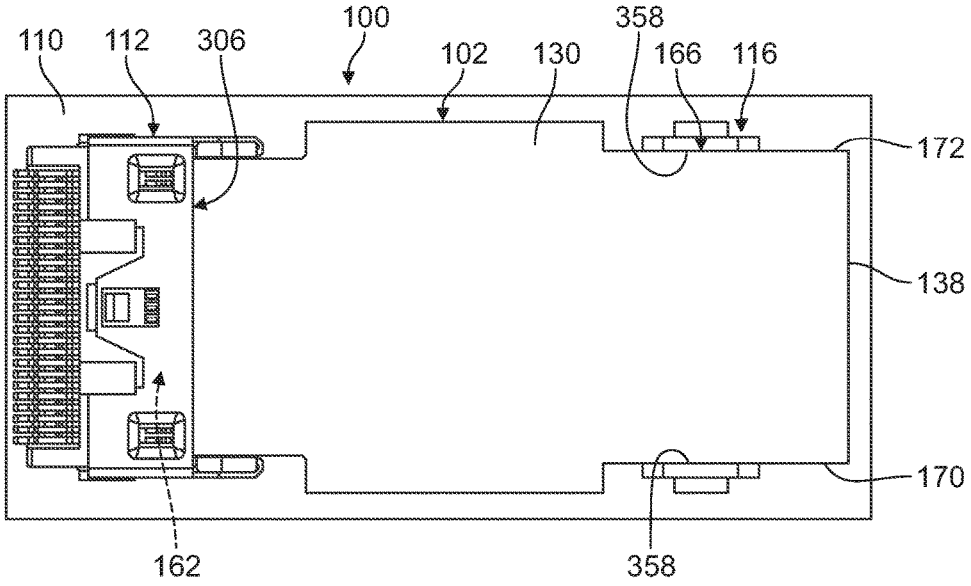
FIG. 7 is a top view of a portion of the dual connector system showing the module circuit board fully mated to the host circuit board.

FIG. 6 is a top view of a portion of the dual connector system 100 showing the module circuit board 130 partially mated to the host circuit board 110. FIG. 7 is a top view of a portion of the dual connector system 100 showing the module circuit board 130 fully mated to the host circuit board 110.

In an exemplary embodiment, mating of the dual connector module 102 to the host circuit board 110 occurs by loading the dual connector module 102 in the loading direction 124 (shown in FIG. 2) to the pre-staged position (FIG. 6), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 7).

During mating, the first connector interface 162 is generally aligned above the first electrical connector 112 and the second connector interface 166 is generally aligned above the second electrical connector 116 and the module circuit board 130 is lowered into position on the first and second electrical connectors 112, 116 to the pre-staged position. The front edge 136 of the module circuit board 130 rests on, and is supported by, the first electrical connector 112 in the pre-staged position (FIG. 6). The front edge 136 of the module circuit board 130 is aligned with the first electrical connector 112 such that the module circuit board 130 may be loaded straight into the first electrical connector 112. Optionally, the first and second side edges 170, 172 near the front edge 136 are stepped inward to allow the module circuit board 130 to plug in to the first electrical connector 112. Optionally, the first and second side edges 170, 172 near the rear edge 138 are stepped inward to fit within the locating surfaces 358 of the second electrical connector 116. However, the side edges 170, 172 do not include notches or other cutouts at the second electrical connector 116 as is typical of conventional module circuit boards that are connected using J-hooks. As such, the module circuit board 130 has more surface area for mounting components and routing traces as compared to conventional module circuit boards.

To complete mating, the dual connector module 102 is moved from the pre-staged position (FIG. 6) to the mated position (FIG. 7) by sliding the module circuit board 130 forward. The front edge 136 is plugged into the card slot 306 to mate with the first electrical connector 112. In the mated position, the second connector interface 166 of the module circuit board 130 is aligned with the second electrical connector 116. The securing strap 150 (shown in FIG. 1) is configured to be coupled to the second electrical connector 116 in the mated position.

Figure 8:
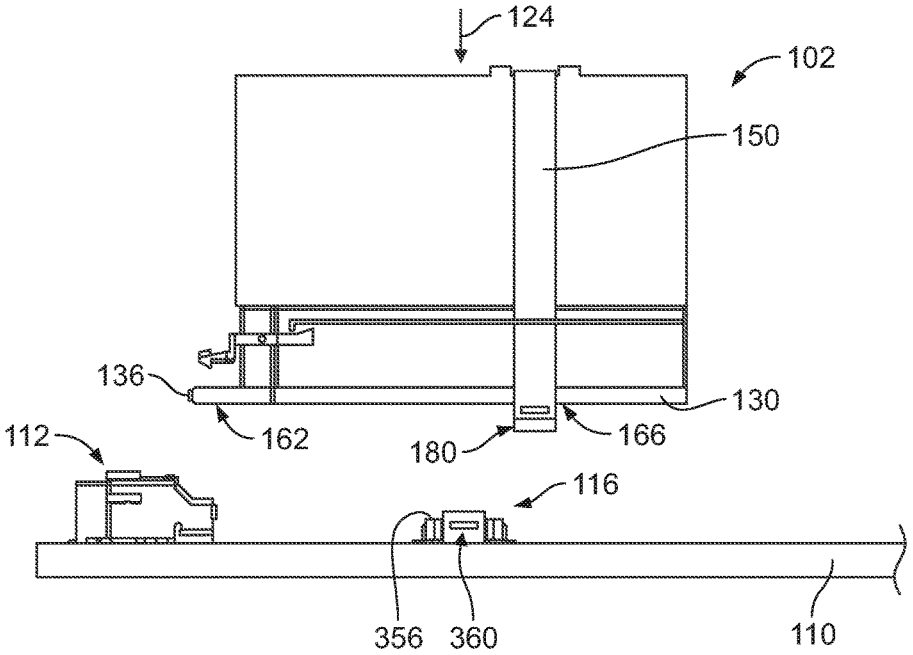
FIG. 8 shows the dual connector module poised for coupling to the host circuit board at an elevated positioned above the host circuit board.
Figure 9:
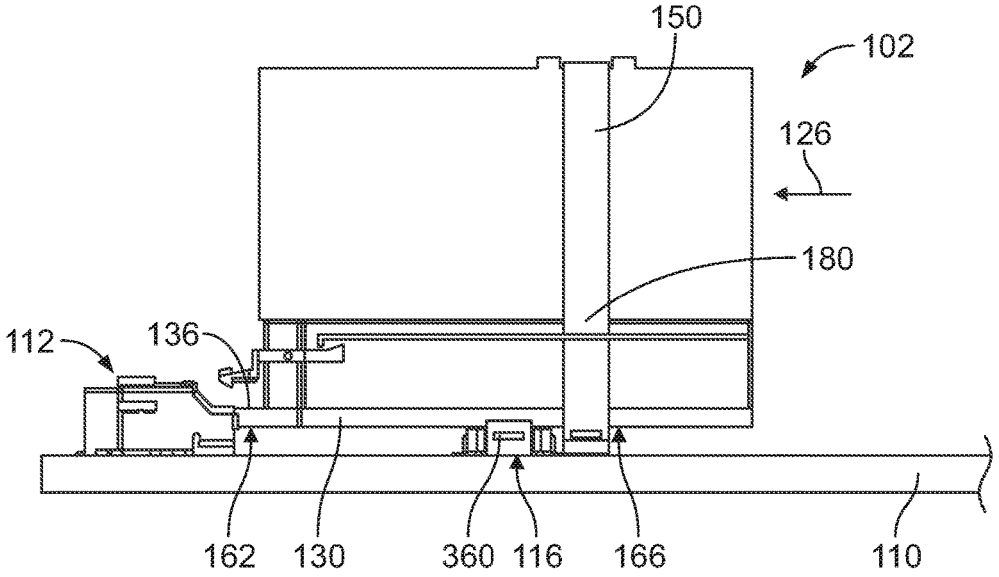
FIG. 9 shows the dual connector module in a pre-staged position on the host circuit board.
Figure 10:
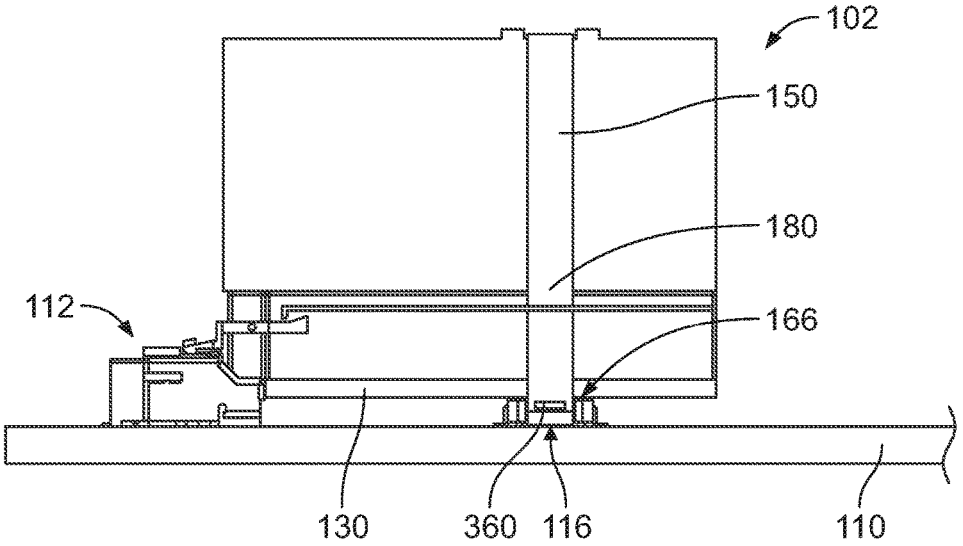
FIG. 10 shows the dual connector module in a mated position on the host circuit board.

FIGS. 8 through 10 show a mating sequence of the dual connector module 102 to the host circuit board 110. FIG. 8 shows the dual connector module 102 poised for coupling to the host circuit board 110 at an elevated positioned above the host circuit board 110. FIG. 9 shows the dual connector module 102 in a pre-staged position. FIG. 10 shows the dual connector module 102 in a mated position.

In an exemplary embodiment, mating of the dual connector module 102 to the host circuit board 110 occurs by loading the dual connector module 102 in the loading direction 124 to the pre-staged position (FIG. 9), such as by loading the dual connector module 102 downward onto the first and second electrical connectors 112, 116. Once positioned, the dual connector module 102 is mated to the first and second electrical connectors 112, 116 by moving the dual connector module 102 in the mating direction 126 to the mated position (FIG. 10).

During mating, the first connector interface 162 is generally aligned above the first electrical connector 112 and the second connector interface 166 is generally aligned above the second electrical connector 116 (FIG. 8) and the module circuit board 130 is lowered into position on the first and second electrical connectors 112, 116 to the pre-staged position (FIG. 9). The front edge 136 of the module circuit board 130 rests on, and is supported by, the first electrical connector 112 in the pre-staged position. As the module circuit board 130 is lowered, the securing strap 150 is positioned relative to the second electrical connector 116, such as partially aligned with or positioned immediately behind the second electrical connector 116.

As the dual connector module 102 is moved from the pre-staged position (FIG. 9) to the mated position (FIG. 10), the dual connector module 102 is moved forward to the mated position. The securing strap 150 is aligned with the second electrical connector 116. The first and second strap latching features 180, 182 (shown in FIG. 3) of the securing strap 150 are aligned with the first and second connector latching features 360, 361. The first and second strap latching features 180, 182 are latchably coupled to the first and second connector latching features 360, 361 to secure the rear end of the dual connector module 102 to the second electrical connector 116. The first and second strap latching features 180, 182 hold the dual connector module 102 downward on the second electrical connector 116 to prevent lift-off of the module circuit board 130 from the upper mating surface 356 of the second electrical connector 116.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board;

a second electrical connector at the rear mounting area of the host circuit board, the second electrical connector having a housing having an upper mating surface, the housing having a first side and an opposite second side, the housing holding second contacts at the upper mating surface between the first and second sides, the second contacts being terminated to the host circuit board, the housing having a first connector latching feature at the first side of the housing;

a dual connector module mated to the first and second electrical connectors, the dual connector module having a module circuit board including an upper surface and a lower surface facing the host circuit board, the module circuit board having at least one communication component on the upper surface, the module circuit board extending between a front edge and a rear edge, the module circuit board having front contact pads proximate to the front edge for electrically connecting to the first electrical connector, the module circuit board having rear contact pads remote from the front edge for electrically connecting to the second electrical connector; and a securing strap secured to the dual connector module, the securing strap having a first strap latching feature at a first end of the securing strap being latchably coupled to the first connector latching feature to secure the dual connector module to the second electrical connector.

2. The dual connector system of claim 1, wherein the securing strap wraps at least partially around the dual connector module.

3. The dual connector system of claim 1, wherein the securing strap includes a second strap latching feature at a second end of the securing strap, the second strap latching feature being latchably coupled to a second connector latching feature at the second side of the second electrical connector to secure the dual connector module to the second electrical connector.

4. The dual connector system of claim 1, wherein the securing strap is a first securing strap, the dual connector system further comprising a second securing strap secured to the dual connector module, the second securing strap having a second strap latching feature being latchably coupled to a second connector latching feature at the second side of the second electrical connector to secure the dual connector module to the second electrical connector.

5. The dual connector system of claim 1, wherein the securing strap holds the dual connector module downward on the upper mounting surface of the second electrical connector.

6. The dual connector system of claim 1, wherein the securing strap induces a downward biasing force on the dual connector module when the first strap latching feature is coupled to the first connector latching feature to force the rear contact pads downward on the second contacts of the second electrical connector.

7. The dual connector system of claim 1, wherein the first connector latching feature includes a latching tab, the first strap latching feature includes an opening receiving the latching tab.

8. The dual connector system of claim 1, wherein the first strap latching feature is deflectable and releasable from the first connector latching feature.

9. The dual connector system of claim 1, wherein the dual connector module includes a guide feature, the securing strap engaging the guide feature to locate the securing strap with respect to the dual connector module.

10. The dual connector system of claim 1, wherein the securing strap is positioned proximate to the rear edge of the module circuit board.

11. The dual connector system of claim 1, wherein the second electrical connector is configured to receive the module circuit board in a vertical loading direction from above the upper mating surface to a loaded position, the second contacts being configured to mate with the module circuit board in a horizontal mating direction as the module circuit board is slid forward from the loaded position to a mated position, the first strap latching feature being aligned with and engaging the first connector latching feature when the module circuit board is slid forward to the mated position.

12. The dual connector system of claim 1, wherein the dual connector module includes a heat sink mounted to the module circuit board to dissipate heat from the at least one communication component, the heat sink having a top, a bottom, and opposite first and second sides, the bottom facing the module circuit board, the securing strap being secured to the first side of the heat sink.

13. The dual connector system of claim 12, wherein the securing strap is secured to the top of the heat sink.

14. The dual connector system of claim 13, wherein the securing strap is secured to the second side of the heat sink, the securing strap including a second strap latching feature being latchably coupled to a second connector latching feature at the second side of the second electrical connector to secure the dual connector module to the second electrical connector.

15. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board;

a second electrical connector at the rear mounting area of the host circuit board, the second electrical connector having a housing having an upper mating surface, the housing having a first side and an opposite second side, the housing holding second contacts at the upper mating surface between the first and second sides, the second contacts being terminated to the host circuit board, the housing having a first connector latching feature at the first side of the housing, the housing having a second connector latching feature at the second side of the housing;

a dual connector module mated to the first and second electrical connectors, the dual connector module having a module circuit board including an upper surface and a lower surface facing the host circuit board, the module circuit board having at least one communication component on the upper surface, the module circuit board extending between a front edge and a rear edge, the module circuit board having front contact pads proximate to the front edge for electrically connecting to the first electrical connector, the module circuit board having rear contact pads remote from the front edge for electrically connecting to the second electrical connector;

a first securing strap secured to the dual connector module, the first securing strap having a first strap latching feature at a distal end of the first securing strap being latchably coupled to the first connector latching feature to secure the dual connector module to the second electrical connector; and a second securing strap secured to the dual connector module, the second securing strap having a second strap latching feature at a distal end of the second securing strap being latchably coupled to the second connector latching feature to secure the dual connector module to the second electrical connector.

16. The dual connector system of claim 15, wherein the first securing strap and the second securing strap are both formed integral with an upper band that wraps across a top of the dual connector module, the first and second securing straps pulling the upper band downward against the dual connector module to force the rear contact pads against the second contacts of the second electrical connector.

17. The dual connector system of claim 15, wherein the first connector latching feature includes a latching tab and the second connector latching feature includes a latching tab, the first strap latching feature includes an opening receiving the corresponding latching tab, the second strap latching feature includes an opening receiving the corresponding latching tab.

18. The dual connector system of claim 15, wherein the second electrical connector is configured to receive the module circuit board in a vertical loading direction from above the upper mating surface to a loaded position, the second contacts being configured to mate with the module circuit board in a horizontal mating direction as the module circuit board is slid forward from the loaded position to a mated position, the first strap latching feature being aligned with and engaging the first connector latching feature when the module circuit board is slid forward to the mated position, the second strap latching feature being aligned with and engaging the second connector latching feature when the module circuit board is slid forward to the mated position.

19. The dual connector system of claim 15, wherein the dual connector module includes a heat sink mounted to the module circuit board to dissipate heat from the at least one communication component, the heat sink having a top, a bottom, and opposite first and second sides, the bottom facing the module circuit board, the first securing strap being secured to the first side of the heat sink, the second securing strap being secured to the second side of the heat sink, the first and second securing straps pulling downward on the top of the heat sink to force the heat sink downward.

20. A dual connector system comprising:

a host circuit board having a front mounting area and a rear mounting area;

a first electrical connector at the front mounting area of the host circuit board, the first electrical connector having a housing having a card slot, the housing holding first contacts at the card slot, the first contacts being terminated to the host circuit board;

a second electrical connector at the rear mounting area of the host circuit board, the second electrical connector having a housing having an upper mating surface, the housing having a first side and an opposite second side, the housing holding second contacts at the upper mating surface between the first and second sides, the second contacts being terminated to the host circuit board, the housing having a first connector latching feature at the first side of the housing;

a dual connector module mated to the first and second electrical connectors, the dual connector module having a module circuit board including an upper surface and a lower surface facing the host circuit board, the module circuit board having at least one communication component on the upper surface, the module circuit board extending between a front edge and a rear edge, the module circuit board having front contact pads proximate to the front edge for electrically connecting to the first electrical connector, the module circuit board having rear contact pads remote from the front edge for electrically connecting to the second electrical connector; and a securing strap secured to the dual connector module, the securing strap having a first strap latching feature at a first end of the securing strap;

wherein the dual connector module is coupled to the host circuit board by lowering the dual connector module in a loading direction generally perpendicular to the host circuit board to a pre-staged position where the first connector interface is adjacent to the first electrical connector and the second connector interface is adjacent to the second electrical connector;

wherein the dual connector module is slid forward from the pre-staged position to a mated position in a mating direction generally parallel to the upper surface of the host circuit board to mate the first connector interface to the first electrical connector by loading the front edge of the module circuit board into the card slot of the first electrical connector to mate the first contacts to the first contact pads and to mate the second connector interface to the second electrical connector to mate the second contacts to the second contact pads; and wherein the first strap latching feature is aligned with and latchably coupled to the first connector latching feature in the mated position to secure the dual connector module to the second electrical connector.

* * * * *